US007814715B2

(12) United States Patent
Coulton et al.

(10) Patent No.: US 7,814,715 B2
(45) Date of Patent: Oct. 19, 2010

(54) ROLLABLE ROOF RIDGE VENT

(75) Inventors: Michael S. Coulton, North Wales, PA (US); George Caruso, Ambler, PA (US); Nathan L. Randello, Hatboro, PA (US); Ted Kerwood-Winslow, Perkiomenville, PA (US)

(73) Assignee: Benjamin Obdyke Incorporated, Horsham, PA (US)

( * ) Notice: Subject to any disclaimer, the term of this patent is extended or adjusted under 35 U.S.C. 154(b) by 551 days.

(21) Appl. No.: 11/781,390

(22) Filed: Jul. 23, 2007

(65) Prior Publication Data

US 2009/0025316 A1 Jan. 29, 2009

(51) Int. Cl.

| | |
|---|---|
| ***E04D 13/00*** | (2006.01) |
| ***E04D 13/152*** | (2006.01) |
| ***E04D 13/17*** | (2006.01) |
| ***E04D 5/00*** | (2006.01) |
| ***F24F 7/02*** | (2006.01) |

(52) U.S. Cl. ..... 52/198; 52/199; 454/364; 454/365

(58) Field of Classification Search ..... 52/198, 52/199; 454/364, 365

See application file for complete search history.

(56) References Cited

U.S. PATENT DOCUMENTS

| | | | | |
|---|---|---|---|---|
| 4,942,699 | A | 7/1990 | Spinelli | |
| 5,095,810 | A * | 3/1992 | Robinson | 454/365 |
| 5,457,920 | A * | 10/1995 | Waltz | 52/199 |
| 5,458,538 | A * | 10/1995 | MacLeod et al. | 454/365 |
| 5,651,734 | A * | 7/1997 | Morris | 454/365 |
| 5,673,521 | A | 10/1997 | Coulton et al. | |
| 5,902,432 | A | 5/1999 | Coulton et al. | |
| 5,934,995 | A * | 8/1999 | Morris et al. | 454/365 |
| 5,947,817 | A * | 9/1999 | Morris et al. | 454/365 |
| 5,960,595 | A | 10/1999 | McCorsley, III et al. | |
| 6,128,869 | A * | 10/2000 | Brotherton et al. | 52/198 |
| 6,149,517 | A * | 11/2000 | Hansen | 454/365 |
| 6,227,963 | B1 * | 5/2001 | Headrick | 454/365 |
| 6,233,887 | B1 * | 5/2001 | Smith | 52/199 |
| 6,260,315 | B1 * | 7/2001 | Smith | 52/199 |
| 6,277,024 | B1 * | 8/2001 | Coulton | 454/365 |
| 6,298,613 | B1 | 10/2001 | Coulton et al. | |
| 6,308,472 | B1 | 10/2001 | Coulton et al. | |
| 6,361,434 | B1 * | 3/2002 | Brandon | 454/365 |
| 6,623,354 | B2 * | 9/2003 | Morris et al. | 454/365 |
| 6,684,581 | B2 * | 2/2004 | Robinson et al. | 52/198 |
| 6,881,144 | B2 * | 4/2005 | Hansen et al. | 454/365 |

(Continued)

*Primary Examiner*—Brian E Glessner
*Assistant Examiner*—Jason Holloway
(74) *Attorney, Agent, or Firm*—Howson & Howson LLP

(57) ABSTRACT

A roof ridge vent comprises a one-piece, elongate body rollable into a spiral roll. The vent body has an elongate upper wall with a pair of longitudinally-extending side edges, an underside, and a plurality of bracing walls depending therefrom. The vent body further includes a pair of grillwork walls with ventilation openings extending downwardly and outwardly from the side edges of the upper wall. Still further, the vent body includes a pair of longitudinally-extending sidewalls that project from the outer edges of each of the grillwork walls and that are disposed upright with respect to the upper wall. Each of the sidewalls has a continuous, longitudinally-extending top strip and a spaced apart pair of longitudinally-extending walls depending from the top strip. The pair of walls includes a series of drainage openings which provide drainage paths through the sidewalls and which permit the sidewalls to be rolled into the spiral roll.

14 Claims, 4 Drawing Sheets

U.S. PATENT DOCUMENTS

| | | | | |
|---|---|---|---|---|
| 6,913,530 | B2 * | 7/2005 | Morris et al. | 454/365 |
| D511,847 | S | 11/2005 | Ciepliski | |
| D511,848 | S * | 11/2005 | Ciepliski | D25/141 |
| 6,981,916 | B2 | 1/2006 | Coulton | |
| 6,991,535 | B2 * | 1/2006 | Ciepliski et al. | 454/365 |
| 7,024,828 | B2 * | 4/2006 | Headrick | 52/198 |
| 7,165,363 | B2 * | 1/2007 | Headrick et al. | 52/198 |
| 7,182,688 | B2 * | 2/2007 | Coulton | 454/365 |
| 7,422,520 | B2 * | 9/2008 | Coulton et al. | 454/365 |
| 7,537,518 | B2 * | 5/2009 | Villela et al. | 454/365 |
| 7,604,536 | B2 * | 10/2009 | Coulton et al. | 454/365 |
| 2002/0032000 | A1 * | 3/2002 | Lawless et al. | 454/365 |
| 2002/0100232 | A1 * | 8/2002 | Robinson et al. | 52/198 |
| 2004/0088928 | A1 * | 5/2004 | Headrick et al. | 52/98 |
| 2004/0237428 | A1 | 12/2004 | Headrick et al. | |
| 2005/0126088 | A1 * | 6/2005 | Rotter | 52/198 |
| 2005/0136831 | A1 * | 6/2005 | Coulton | 454/365 |
| 2006/0040608 | A1 | 2/2006 | Coulton | |
| 2006/0079173 | A1 | 4/2006 | Coulton et al. | |
| 2006/0154597 | A1 * | 7/2006 | Coulton et al. | 454/365 |
| 2006/0211366 | A1 * | 9/2006 | Villela et al. | 454/365 |
| 2006/0229010 | A1 * | 10/2006 | Villela et al. | 454/365 |
| 2007/0054612 | A1 | 3/2007 | Ehrman et al. | |
| 2009/0253368 | A1 * | 10/2009 | Rotter | 454/365 |

* cited by examiner 30
24
52
26
30
72
70
74
54
56
42
46
40
58
72
74
46
70
34
68
38
38
68
48
74
34
4
10
36
48
18
20
4
36
22
22
20
18
16

FIG.2A
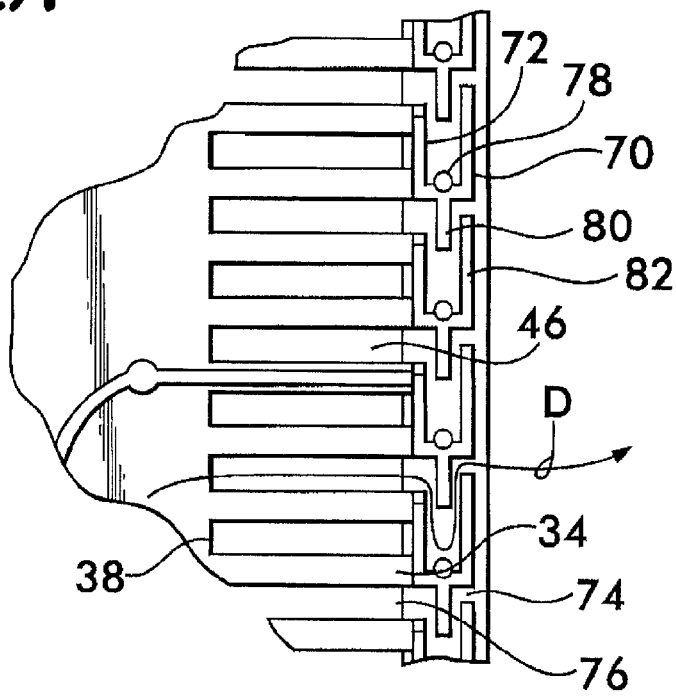
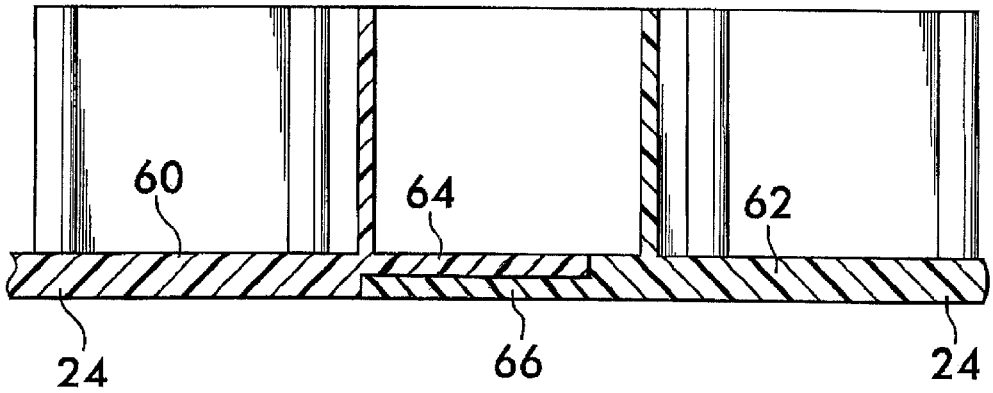
FIG.3

ROLLABLE ROOF RIDGE VENT

BACKGROUND OF THE INVENTION

The present invention relates to a vent enabling free air exchange between an area within a building and ambient atmosphere, and more particularly, the present invention relates to a vent for installation on a roof ridge of a building.

It is useful, and in many locales a building code requirement, that certain interior areas of a building, such as an area underneath a roof, be provided with a means to permit air exchange. The ventilation prevents undue heat buildup that can render the living quarters of the building uncomfortable and that can impose unreasonable energy requirements for cooling. Proper ventilation also preserves the structural integrity of the building structure, such as the roof and roof coverings.

A combination of ridge and soffit vents provides an example of a means for providing attic ventilation. The ridge vent permits hot and/or humid air to rise up through the peak of the roof and the soffit vent enables ambient air to be drawn into a lower part of the attic area to replace the hot and/or humid air escaping through the ridge vent.

Examples of roof ridge vents are provided by U.S. Pat. No. 5,960,595 issued to McCorsley et al., U.S. Pat. Nos. 6,298,613 B1, 6,308,472 B1, 5,902,432 and 5,673,521 issued to Coulton et al., U.S. Pat. Nos. 6,277,024 B1, 6,981,916 B2 and 7,182,688 B2 issued to Coulton, and U.S. Pat. No. 4,942,699 issued to Spinelli and U.S. Patent Application Publications Nos. 2007/0054612 A1 of Ehrman et al., 2006/0079173 A1 and 2006/0154597 A1 of Coulton et al., and 2006/0040608 A1 of Coulton. Each of the above referenced patents and published applications are owned, or co-owned, by Benjamin Obdyke Incorporated, the assignee of the present application, and all but one disclose a roof ridge vent that can be rolled into a spiral roll after manufacture. The exception is U.S. Pat. No. 6,277,024 B1 issued to Coulton which discloses an injection-molded, shingle-over, sectional roof ridge vent currently being sold under the trademark XTRACTOR VENT®.

Injection-molded, shingle-over roof ridge vents that are rollable are disclosed by U.S. Pat. Nos. 6,233,887 B1 and 6,260,315 B1 issued to Smith, U.S. Pat. No. 6,684,581 B2 issued to Robinson et al., U.S. Pat. No. 6,881,144 B2 issued to Hansen et al., D.511,847 S and D.511,848 S of Ciepliski, U.S. Pat. No. 6,991,535 B2 issued to Ciepliski et al., and U.S. Pat. No. 7,024,828 B2 issued to Headrick and by U.S. Patent Application Publication Nos. 2004/0088928 A1 and 2004/0237428 A1 of Headrick et al. and 2006/0211366 A1 and 2006/0229010 A1 of Villela et al. U.S. Pat. No. 6,128,869 issued to Brotherton et al. discloses an injection-molded, shingle-over, sectional roof ridge vent having rows of spaced-apart baffles along outer longitudinally-extending edges of the vent.

While the sectional and rollable vents disclosed by the above referenced patents and published applications may function in an acceptable manner, there continues to be a need for alternatives with respect to the design, manufacture and installation of roof ridge vents. A desired vent should permit a sufficient amount of ventilating air flow without compromising weather infiltration resistance and should be capable of being properly installed in a manner requiring labor skills possessed by the average roof installer. In addition, the vent should be capable of efficient manufacture, storage, transportation and handling.

BRIEF SUMMARY OF THE INVENTION

The present invention provides a roof ridge vent comprising a one-piece, elongate body rollable into a spiral roll. The vent body has an elongate central longitudinally-extending upper wall having a pair of side edges, an underside, and a plurality of bracing walls depending therefrom. The vent body further includes a pair of grillwork walls with ventilation openings. The grillwork walls extend downwardly and outwardly from the side edges of the upper wall. Still further, the vent body includes a pair of longitudinally-extending sidewalls that are disposed upright with respect to the upper wall and that provide external wind baffles for the vent. The sidewalls project from outer edges of the grillwork walls, and each sidewall has a continuous, longitudinally-extending top strip. A spaced-apart pair of longitudinally-extending walls depends from the top strip and includes a series of drainage openings that provide drainage paths through the sidewalls and that permit the sidewalls to be rolled into the spiral roll.

According to some contemplated embodiments of the vent of the present invention, walls depending from the top strip of each sidewall form a plurality of spaced apart fork-shaped members arranged in tongue and groove relation. This arrangement produces circuitous drainage paths through the sidewalls.

BRIEF DESCRIPTION OF THE DRAWINGS

The foregoing and other features and advantages of the present invention should become apparent from the following description when taken in conjunction with the accompanying drawings, in which:

FIG. 2A is an enlarged view of a portion of the roof ridge vent of FIG. 2;

FIG. 3 is a cross-sectional view along line 3-3 of FIG. 2 of a juncture of two ends of the roof ridge vent according to the present application.

DETAILED DESCRIPTION OF THE INVENTION

Figure 1:
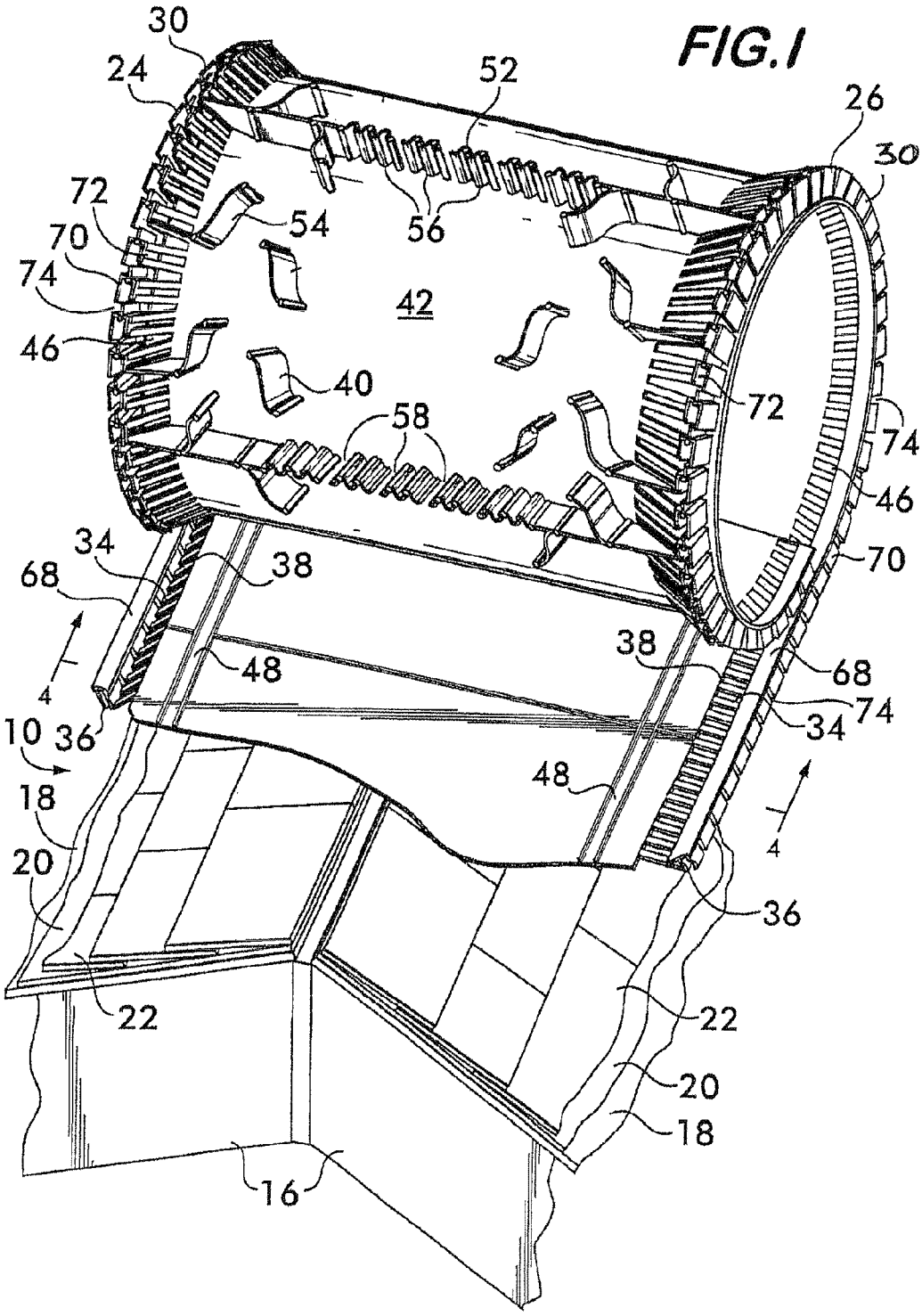
FIG. 1 is a perspective view of a spiral roll of the roof ridge vent according to the present invention as it is being applied to a ridge of a roof.
Figure 4:
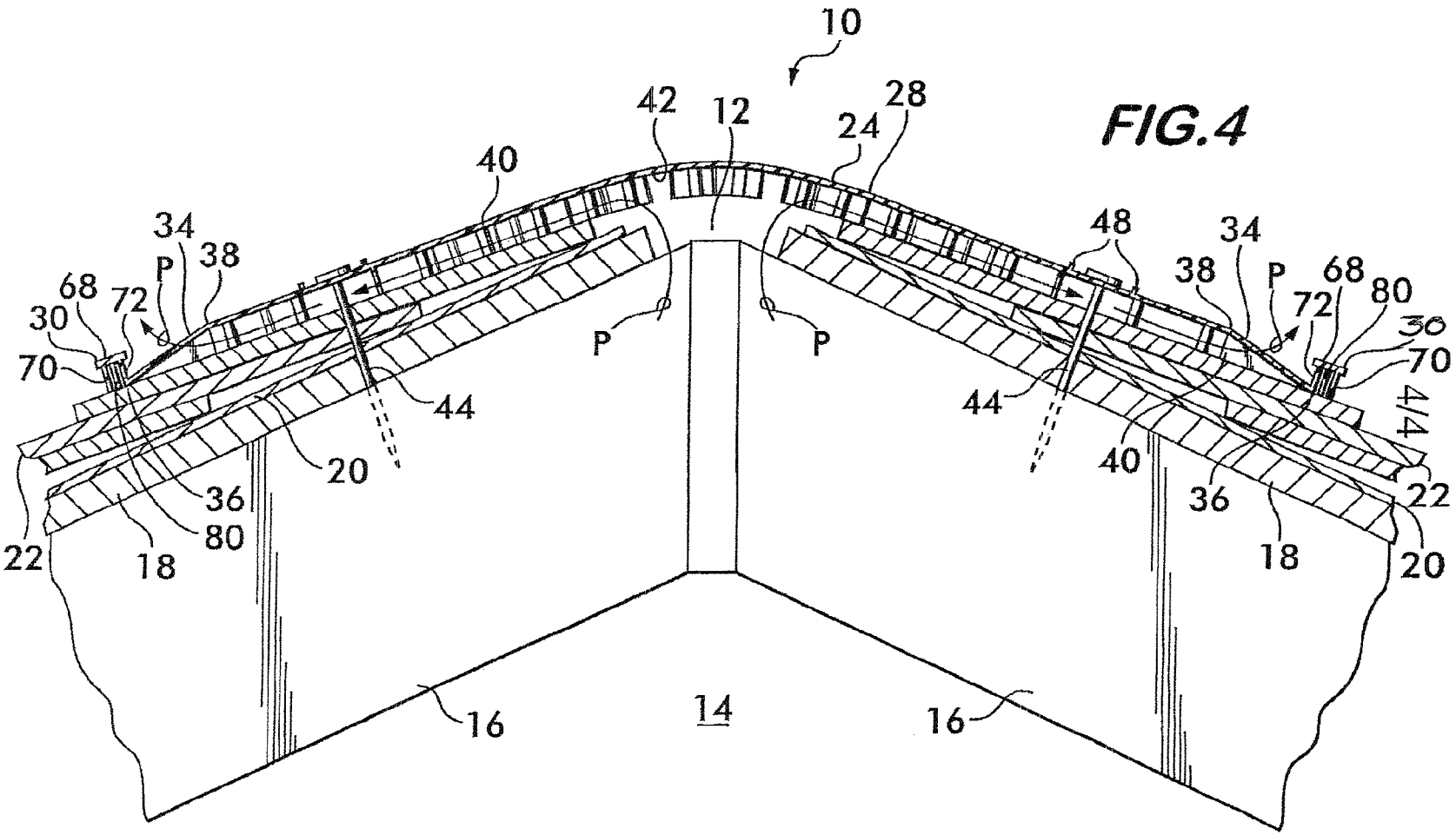
FIG. 4 is a cross sectional view taken along line 4-4 in FIG. 1 of the vent installed on a roof ridge.

FIGS. 1 and 4 illustrate a typical construction of a roof ridge 10 of a building to which a ridge vent can be applied. An elongate slot-shaped opening 12 is provided continuously or intermittently along almost an entire length of the roof ridge 10. This enables hot and/or humid air to escape an area 14 underlying the roof at just about any point along the length of the ridge 10 to ambient atmosphere. Roof ridge vents are utilized to cover the opening 12 and provide air ventilation passageways "P" (see arrows in FIG. 4) from the opening 12 to ambient atmosphere. In addition, the vents should prevent undesired infiltration of wind blown rain, snow or other debris into the opening 12 and should provide a support for cap shingles applied over the vent.

As an example of ridge construction, the illustrated roof ridge 10 includes a plurality of rafters 16 supported at lower ends, for instance, by front and rear walls (not shown) of the building. A roof deck 18, typically constructed of plywood or other suitable panels, is secured to the rafters 16 to provide an outer sheathing material of the roof over which roofing felt or like membrane 20 and roofing shingles 22 are applied. Thereafter, an elongate roof ridge vent 24 is installed on the roof ridge 10 overlying the elongate slot-shaped opening 12 and adjacent surrounding portions of the roof deck 18.

According to the present invention, the vent 24 is an elongate continuous single piece which is provided to the building site in a spiral roll 26. See FIG. 1. The ability of the vent 24 to be provided in a spiral roll 26 enables the vent 24 to be readily stored and transported to the building site despite being of a length sufficient to span the entire length of the roof ridge 10. This is in contrast to so-called sectional roof ridge vents which are provided in separate, non-rollable four foot lengths and which are installed in an aligned end-to-end relation across the roof ridge 14 to form a completed vent structure. As an example of a sectional roof ridge vent, see U.S. Pat. No. 6,277,024 B1 issued to Coulton, the disclosure of which is incorporated herein by reference.

Alternatively, the continuous single piece vent 24 of the present invention can form a portion of an elongate vent structure. For example, the ends of two separate pieces of the vent 24 of the present invention can be joined to from a vent extending the length of the ridge. Thus, when the vent 24 of the present invention is cut to fit a particular roof ridge, any remaining length of the vent 24 does not need to be discarded as scrap and can be used in the installation of a ridge vent on another ridge. Accordingly, if the remaining length is insufficient to extend the entire length of the ridge, its end can be mated and joined to the end of a second like vent. See FIGS. 2 and 3 with respect to joining the ends of vents 24 discussed in greater detail below.

Further, the vent 24 of the present invention can be used in combination with sectional ridge vents to form a completed vent structure. The profile of the rollable vent 24 of the present invention can be manufactured such that it substantially matches the profile of a sectional ridge vent, such as that disclosed in U.S. Pat. No. 6,277,024 B1 issued to Coulton. Thus, a vent extending along the length of a roof ridge can comprise a combination of a rollable molded vent and a non-rollable, sectional molded vent thereby enabling fall use of all building materials.

The vent 24 of the present invention is preferably made of a thermoplastic material and is preferably produced using injection molding techniques. For example, the vent 24 can be made of numerous separate injection molded sections that are welded or bonded together in end-to end relationship to produce a single elongate vent that can be stored and shipped in roll-form. As an example, multiple injection molded sections can be aligned end-to end and overlapping portions of each adjacent pair of sections can be ultrasonically welded together to produce a single elongate vent of any desired length. Alternatively, other molding techniques can be used as well as other materials, such as metal, synthetic rubber, composite materials, and the like. Other bonding or welding techniques can also be used. Thus, any manufacturing technique or material can be utilized provided that a continuous length of vent can be produced and rolled into a spiral roll after manufacture so that it can be readily stored, transported to a building site, and handled as a relatively long single piece in roll form.

The structure of the vent 24 of the present invention is similar in many ways to the structure of the sectional ridge vent disclosed in U.S. Pat. No. 6,277,024 B1 issued to Coulton. For instance, the vent 24 includes a longitudinally-extending upper wall 28, a pair of outer longitudinally-extending sidewalls 30 providing wind baffles, grillwork or the like openwork wall structures 34 interconnecting the base 36 of each of the sidewalls 30 to one of the outer peripheral longitudinal edges 38 of the upper wall 28, and a plurality of supports 40 depending from an underside 42 of the upper wall 28 and grillwork 34 to space the upper wall 28 and grillwork 34 from an underlying surface of the ridge 10. Each of these components is discussed below in greater detail.

The elongate upper wall 28 extends longitudinally from one end of the vent 24 to the other. The upper wall 28 can be provided as a solid wall, as illustrated, or can have openings, perforations, or windows formed therein to reduce material costs or to enable ready installation. Preferably, a pair of nailing lines 48 are defined, imprinted, or molded on the upper surface of the upper wall 28 such that, when the vent 24 is installed on a ridge 10, the nailing lines 48 extend parallel to the elongate opening 12 and on opposite sides of the ridge 10. Thus, as illustrated in FIG. 4, nails or like fasteners 44 are driven through the nailing lines 48 to secure the vent 24 to the ridge 10, and the upper wall 28 and grillwork 34 are elevated above the surface of the roof ridge by supports 40 to enable ventilation passages "P" to extend from the opening 12 in the roof ridge 10 to ventilation openings 46 provided by grillwork 34. The upper wall 28 also provides a surface to which cap shingles (not shown) can be applied and supported to provide the roof ridge 10 with an aesthetically pleasing finished appearance.

As discussed above, grillwork 34 extends from each outer peripheral edge 38 of the upper wall 28 in a downwardly angled direction to the bases 36 of the sidewalls 30, which extend generally perpendicular to the upper wall 28. Thus, as best illustrated in FIG. 4, the grillwork 34 extends in a direction obliquely or inclined relative to both the upper wall 28 and sidewalls 30, and the sidewalls 30 project upwardly from the outer edges of the grillwork 34. The upper wall 28, grillwork 34, and sidewalls 30 are all molded integrally, and the grillwork 34 includes ventilation openings 46 which provide direct communication between the ventilation passages "P" of the vent 24 and ambient atmosphere.

The supports, or bracing members, 40 are also molded integrally with the upper wall 28 and grillwork 34 and depend from the underside 42 of the upper wall 28 as well as the grillwork 34. The bracing members 40 support and space the upper wall 28 and grillwork 34 above the underlying surface of the roof ridge 10 and can be substantially identical to those disclosed in U.S. Pat. No. 6,277,024 B1 issued to Coulton. For example, the bracing members 40 can include longitudinally extending rows of support walls as well as transversely extending support walls 52 extending from grillwork 34 adjacent sidewall 30 to grillwork 34 adjacent the opposite sidewall 30.

The support walls 40 can include four spaced-apart and staggered longitudinally-extending walls in rows R1, R2, R3 and R4, and each wall 40 can be made from a plurality of longitudinally-spaced wall segments 54 providing ventilation air passageways "P" therebetween. A pair of the rows, R1/R2, depend from one side of the upper wall 28, and a second pair, R3/R4, depend from the other side. Preferably, the wall segments 54 in each pair of rows are offset and staggered so that the support walls 40 function as baffles preventing precipitation blown through the ventilation openings 46 of the vent 24 from reaching the ridge opening 12. If desired, a high loft, non-woven fabric, or like filter material can be mounted on the underside 42 of the upper wall 28 to provide additional protection against weather, debris, and/or insect infiltration.

Preferably, each of the pairs of rows, R1/R2 and R3/R4, are positioned such that one of the nail lines 48 extends between one of the pairs of the rows of support walls 40. Accordingly, nails 44 are applied through the nail lines 48 without obstruction from the support walls 40. In addition, preferably each segment 54 has an undulating configuration in transverse cross-section such that each segment 54 forms a sinusoidal-shaped juncture with the upper wall 28. This configuration enables each wall segment 54 to resist unwanted hinging about its juncture to the upper wall 28. Thus, the shape of the wall segments 54 enhances top loading strength of the vent 24 and provides resistance against unwanted compression or fracture of the upper wall 28 when the vent 24 is installed with nails fired by roofing nail guns.

The support walls 52 extend transversely across the underside 42 of the upper wall 28 of the vent from one grillwork 34 to the other. Preferably, the transverse walls 52 are uniformly spaced apart at pre-determined intervals along the length of the vent 24. For example, the walls 52 can be located at six inch intervals on the underside 42 of the vent 24. Each transverse wall 52 rigidities the vent 24, supports the upper wall 28 and grillwork 34 at a desired position above the roof surface, and provides additional blocks to weather infiltration within the vent 24 relative to the longitudinal direction. Thus, each wall 52 provides an end-plug like structure that is repeated at uniform intervals throughout the length of the vent. Accordingly, if the vent 24 is cut to a desired length, an end plug structure provided by one of the walls 52 will always conveniently be located in close proximity to the cut edge of the vent 24.

The structure of the integrally formed transverse walls 52 must permit the upper wall 28 to readily flex about its longitudinal centerline "CL" to enable the vent 24 to conform to the contour of the roof ridge 10, for instance, as shown in FIG. 4. Thus, each of the transverse walls 52 includes a plurality of separate, spaced-apart wall segments 56 depending from the upper wall 28 in end-to-end single file alignment across the centerline "CL" of the upper wall 28 of the vent 24. See FIG. 2. Each adjacent pair of wall segments 56 is spaced apart and forms an open gap 58 therebetween to provide the walls 52 with flexibility. When the upper wall 28 is positioned in a planar position, as manufactured, the gaps 58 taper outwardly and widen as they extend from the upper wall 28, and when the upper wall 28 is flexed about the roof ridge 10, each pair of adjacent wall segments 56 pivots toward each other and narrows the size of the gap 58.

As illustrated, each transverse wall 52 has five wall segments 56 defining four gaps 58. Preferably, selected portions of the wall segments 56 have an undulating configuration that interconnects to the upper wall 28 via a sinusoidal shaped juncture. The undulating configuration resists hinging along the juncture and unwanted compression of the upper wall 28. In addition, when the vent 24 is installed on a roof ridge 10 of a steeply sloped roof, the undulating portions of the wall segments 56 permit adjacent wall segments to engage and become slightly flexed to permit the required degree of bending of the vent 24 about the ridge 10. The transverse walls 52 also include opposite planar portions extending to and underneath the grillwork 34.

Figure 2:
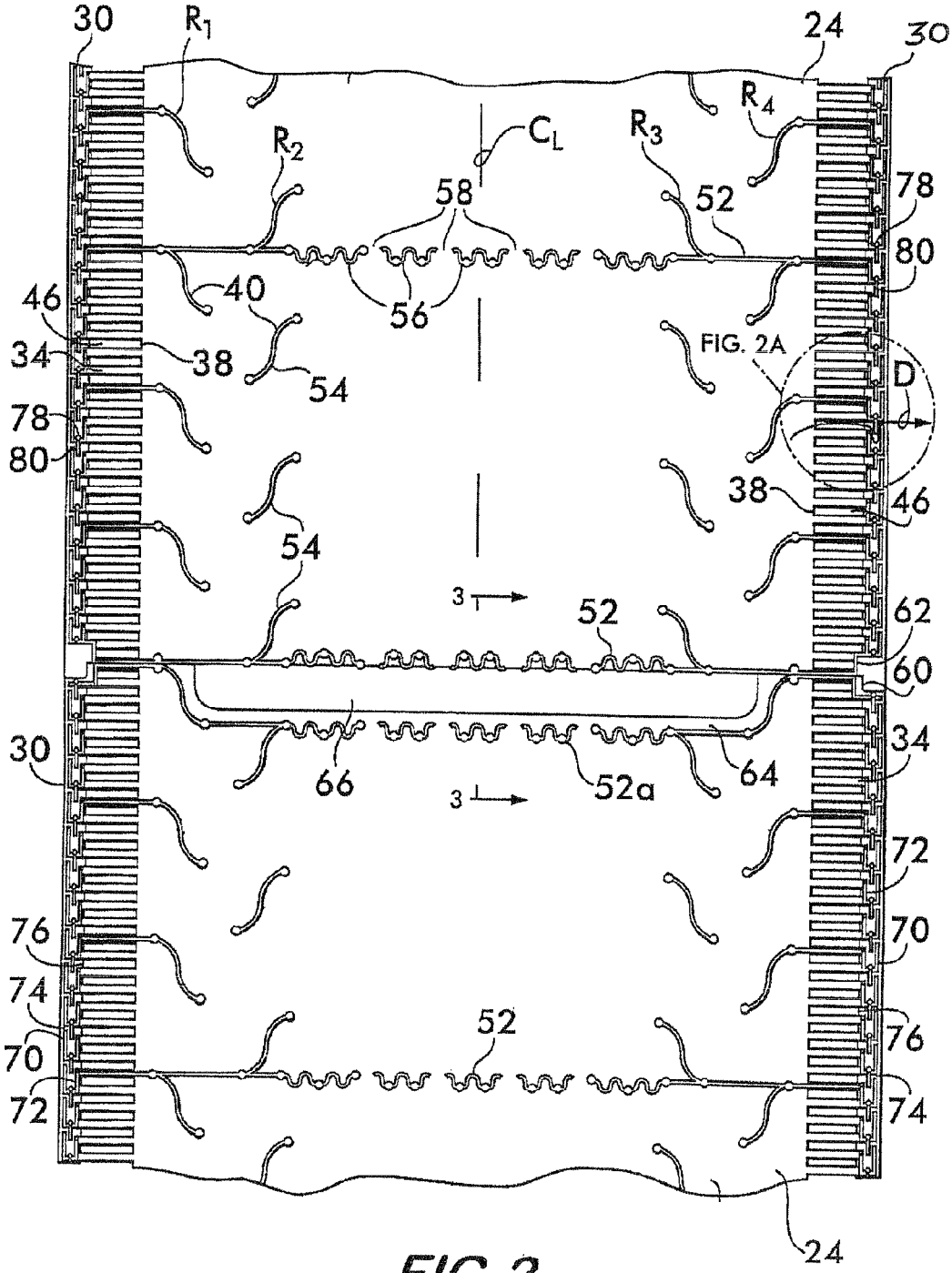
FIG. 2 is a plan view of the underside of the roof ridge vent according to the present.

Each elongate vent 24 has opposite ends, 60 and 62, that can be abutted with and joined to a separate rollable or sectional vent having a like profile. A transverse wall 52*a* extends adjacent the end 60 and is inset therefrom providing a recessed area 64. The opposite end 62 includes an outwardly extending tab, flange or the like 66. As shown in FIGS. 2 and 3, the tab 66 is received in the recessed area 64 thereby forming a joint between the engaged ends of the vents. In addition, in manufacturing the vent 24, each separate injection molded section can include an end with the tab 66 and an end with the recessed area 64. Each adjacent pair of molded sections can be bonded together by aligning the tab 66 of one section in the recessed area 64 of an adjacent section and by ultrasonically welding the tab 66 to the recessed area 64 to form a continuous rollable vent of indeterminate length.

As installed, the longitudinally-extending sidewalls 30 of the vent 24 of the present invention provide a similar function to that provided by the corresponding sidewalls of the sectional vent of U.S. Pat. No. 6,277,024 B1 issued to Coulton. However, the sidewalls 30 of the present invention are of a novel configuration that permits the vent 24 to be rolled into a spiral roll 26.

Each sidewall 30 includes a planar top strip 68 extending continuously between opposite ends 60 and 62 of the vent 24. When the vent 24 is in a flattened uninstalled condition, as manufactured, the strips 68 are substantially level and coplanar with the upper wall 28. A pair of longitudinally-extending walls, 70 and 72, depend from each strip 68. The outer wall 70 provides a wind baffle for the vent 24, and a base section 36 of the inner wall 72 interconnects to the grillwork 34. Preferably, these walls are substantially planar and are parallel to one another.

The outer and inner walls 70 and 72 are spaced apart and each have a series of small drainage openings, 74 and 76. As an example, the drainage openings 74 in wall 70 may have a width of only about 0.06 inch. The purpose of the openings 74 and 76 is to permit rainwater, melted snow or ice, or like fluid that passes through grillwork 34 onto the roof surface under the vent 24 a path to drain down the slope of the roof through the sidewalls 30. In addition, these relatively small openings 74 and 76 are sufficient to permit the vent 24, including the sidewalls 30, to be rolled into a spiral roll 26. As best illustrated in FIG. 1, the vent 24 is rolled such that the underside 42 of the vent 24 faces outwardly of the spiral roll 24. In this position, the drainage openings 74 and 76 permit expansion of the sidewalls 30 and permit the sidewalls 30 to flex into an arcuate configuration. When installed, the sidewalls 30 are returned to their as manufacture configuration with the drainage openings 74 and 76 remaining open, although of a smaller and more uniform shape.

Preferably, the drainage openings 76 in the inner wall 72 are located directly behind and are aligned with the drainage openings 74 in the outer wall 70. See FIGS. 2 and 2A. In the illustrated embodiment of the present invention, the drainage openings 74 in the outer wall 70 are smaller in width than the ventilation openings 46 of the grillwork 34. Thus, the drainage openings 76 of the inner wall 72 may be slightly larger than the drainage openings 74 in the outer wall 70 since the openings 76 may be of an equal size relative to the ventilation openings 46 of the grillwork 34.

Preferably, the sidewalls 30 include a series of support walls 78 that depend from the strips 68 and that extend in a transverse direction across the strips 68 adjacent each aligned pair of drainage openings 74 and 76. In addition, preferably a short wall segment 80 extends from a midpoint of the support walls 78 in a longitudinally-extending direction on the strip 68. Thus, the wall segments 80 extend intermediate of the outer and inner walls 70 and 72 and between each pair of aligned drainage openings 74 and 76. Accordingly, for rainwater or the like to drain from a drainage opening 76 of the inner wall 72 to an aligned drainage opening 74 of the outer wall 70, the water must travel a circuitous route "D" through the sidewall, 30 or 32, defined by the support walls 78 and wall segments 80. See FIG. 2A. Of course, any windblown rain, snow or like debris must pass through the same circuitous route to enter through the sidewalls 30 into the vent 24. Accordingly, this arrangement effectively blocks any unwanted entry of blowing rain, snow or the like into the vent 24 through the sidewalls 30, yet permits rolling of the vent 24.

Based on the above described arrangement, a double-pronged fork-shaped member 82 is formed by the interconnecting outer wall 70, inner wall 72, support wall 78, and wall segment 80 between each adjacent pair of aligned drainage openings 74 and 76. Each fork-shaped member 82 is arranged in a tongue and groove manner with respect to adjacent fork-shaped members 82. For instance, the outer wall 70, inner wall 72 and support wall 78 of each member 82 forms a groove, and the wall segment 80 of each member 82 forms a tongue. See FIG. 2A. In addition, each adjacent pair of fork-shaped members 82 are spaced apart thereby providing the relatively-narrow, circuitous drainage passages "D" through the sidewalls 30. The fork-shaped, or tongue and groove, members 82 enhance the strength of the sidewalls and prevent undesired fracture thereof. Further, the fork-shaped, or tongue and groove, members 82 enable rolling of the vent 24 without damage to the sidewalls 30.

According to the present invention, the above described vent 24 is manufactured in continuous, indefinite length and is rolled into a spiral roll 26. The vent 24 is stored and transported to the building site in roll form and can be unrolled on the roof ridge 10. An end of the vent 24 can be secured with nails to the roof ridge 10 approximately one inch from the end of the roof ridge. Preferably, the vent 24 is secured with standard 1¾ inch roofing nails 44 applied by standard roofing nail guns. If necessary, the vent 24 is cut to approximately the length of the roof ridge 10, or alternatively, is abutted and joined to the end of a separate rollable vent 24, or to a separate non-rollable sectional vent of similar profile. After vent installation is completed, cap shingles can be nailed in overlapping fashion on the roof ridge vent 24 utilizing standard 1¾ inch roofing nails applied by standard roofing guns.

As best illustrated in FIG. 4, the installed vent 24 provides a path of circulation for air exiting the building through the ridge opening 12. The air is directed laterally between the vent 24 and the surface of the roof underlying the vent 24 to and through ventilation openings 46 in the grillwork 34. The sidewalls 30 provide wind baffles and prevent weather infiltration therethrough while permitting rain and/or melt water to drain therethrough.

The above-described rollable vent according to the present invention provides a roof ridge vent which is easy to install, inexpensive to manufacture, and enables use of standard pneumatic roofing nail guns. Various modifications can be made to the vent such as its size and venting capability.

While a preferred roof ridge vent, ridge vent assembly, and method have been described in detail, various modifications, alterations, and changes may be made without departing from the spirit and scope of the present invention as defined in the appended claims.

The invention claimed is:

1. A roof ridge vent, comprising:

a one-piece, elongate body having opposite ends and being rollable into a spiral roll;

said body having an elongate upper wall extending from one of said opposite ends to the other, said upper wall having a pair of longitudinally-extending side edges, an underside, and a plurality of bracing walls depending from said underside;

said body having a pair of openwork walls with ventilation openings, one of said openwork walls extending downwardly and outwardly from one of said side edges of said upper wall and the other of said openwork walls extending downwardly and outwardly from the other of said side edges of said upper wall; and said body having a pair of longitudinally-extending sidewalls disposed upright with respect to said upper wall and providing external wind baffles for the vent, one of said sidewalls projecting from an outer edge of one of said openwork walls and the other of said sidewalls projecting from an outer edge of the other of said openwork walls;

each of said sidewalls having a longitudinally-extending elongate top strip and walls depending from said top strip forming a plurality of spaced apart fork-shaped members arranged in tongue and groove relation that form circuitous drainage paths therebetween through said sidewall and permit said sidewall to be rolled into said spiral roll.

2. A vent according to claim 1, wherein each of said forked-shaped members includes an outer wall providing the external wind baffle and an inner wall having a base section connecting to said outer edge of said openwork wall.

3. A vent according to claim 2, wherein said inner and outer walls of each of said forked-shaped members are substantially planar and parallel.

4. A vent according to claim 3, wherein said top strip of each of said sidewalls is planar and extends perpendicularly relative to said inner and outer walls.

5. A vent according to claim 4, wherein, when the vent is in an installed as manufactured flat condition, said top strips of said sidewalls are co-planar with said upper wall of said body.

6. A vent according to claim 1, wherein said openwork walls extend obliquely relative to said sidewalls and said upper wall.

7. A vent according to claim 1, wherein said body is an injection-molded body.

8. A vent according to claim 7, wherein said injection-molded body is made of a plurality of separate injection molded sections that are aligned end-to-end and are bonded or welded together to form said one-piece, elongate body.

9. A vent according to claim 1, wherein said body is made of a thermoplastic material.

10. A vent according to claim 1, wherein, when said body is in said spiral roll, said underside of said upper wall faces outward of said spiral roll.

11. A roof ridge vent, comprising:

a one-piece, plastic, elongate body having opposite ends and being rollable into a spiral roll;

said body having an elongate upper wall extending from one of said opposite ends to the other, said upper wall having a pair of longitudinally-extending side edges, an underside, and a plurality of bracing walls depending from said underside;

said body having a pair of grillwork walls with ventilation openings, one of said grillwork walls extending downwardly and outwardly from one of said side edges of said upper wall and the other of said grillwork walls extending downwardly and outwardly from the other of said side edges of said upper wall; and said body having a pair of longitudinally-extending sidewalls disposed upright with respect to said upper wall and providing external wind baffles for the vent, one of said sidewalls projecting from an outer edge of one of said grillwork walls and the other of said sidewalls projecting from an outer edge of the other of said grillwork walls;

each of said sidewalls having a substantially continuous, longitudinally-extending planar top strip and walls depending from said top strip forming a plurality of spaced apart fork-shaped members arranged in tongue and groove relation and forming circuitous drainage paths therebetween through said sidewall.

12. A vent according to claim 11, wherein said walls depending from said top strip of each of said sidewalls include a substantially planar outer wall providing the external wind baffle and having a series of spaced apart drainage openings and an inner wall that is spaced from and substantially parallel to said outer wall and that has a base section molded integrally to said outer edge of said grillwork wall.

13. A vent according to claim 12, wherein said inner wall has a plurality of drainage openings that are aligned directly behind said drainage openings in said outer wall.

14. A vent according to claim 11, wherein said one-piece elongate body is made of a plurality of separate injection molded sections that are aligned end-to-end and that are ultrasonically welded together, and wherein said body is made of a thermoplastic material.

* * * * *